US007471179B2

(12) United States Patent
Hatakeyama et al.

(10) Patent No.: US 7,471,179 B2
(45) Date of Patent: Dec. 30, 2008

(54) COIL COMPONENT

(75) Inventors: Yutaka Hatakeyama, Tokyo (JP); Kouzou Kajiwara, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/812,058

(22) Filed: Jun. 14, 2007

(65) Prior Publication Data

US 2008/0003865 A1 Jan. 3, 2008

(30) Foreign Application Priority Data

Jun. 30, 2006 (JP) ..... 2006-181882

(51) Int. Cl.
*H01F 27/29* (2006.01)

(52) U.S. Cl. ..... 336/192

(58) Field of Classification Search ..... 336/65, 336/83, 107, 192, 200, 232
See application file for complete search history.

(56) References Cited

U.S. PATENT DOCUMENTS

| | | | | |
|---|---|---|---|---|
| 6,154,112 | A * | 11/2000 | Aoba et al. | 336/192 |
| 6,157,283 | A * | 12/2000 | Tsunemi | 336/192 |
| 6,373,366 | B1 * | 4/2002 | Sato et al. | 336/192 |
| 6,427,315 | B1 * | 8/2002 | Kitagawa et al. | 29/602.1 |
| 6,535,095 | B2 * | 3/2003 | Aoki et al. | 336/83 |

FOREIGN PATENT DOCUMENTS

| | | | |
|---|---|---|---|
| JP | 57092807 | A * | 6/1982 |
| JP | A-4-369811 | | 12/1992 |
| JP | A-6-141432 | | 5/1994 |
| JP | A 10-153621 | | 6/1998 |
| JP | A 2004-14671 | | 1/2004 |
| JP | A 2005-93564 | | 4/2005 |
| JP | A 2005-142459 | | 6/2005 |
| JP | A-2005-322675 | | 11/2005 |
| JP | A 2006-121013 | | 5/2006 |
| JP | A-2007-67206 | | 3/2007 |

OTHER PUBLICATIONS

U.S. Appl. No. 11/812,053, filed Jun. 14, 2007 in the name of Yutaka Hatakeyama et al.

* cited by examiner

*Primary Examiner*—Tuyen T. Nguyen
(74) *Attorney, Agent, or Firm*—Oliff & Berridge, PLC

(57) ABSTRACT

Each terminal electrode has a welded portion at which each end portion of a conducting wire is electrically connected to each terminal electrode upon laser welding. The conducting wire is provided with an insulation coating. The insulation layer has an edge on the surface of the conducting wire. Each welded portion has a bulge portion bulging in a direction away from the core and in contact with only the edge of the insulation coating. The edge determines a shape position and size of a melted bulge portion.

6 Claims, 3 Drawing Sheets

COIL COMPONENT

CROSS-REFERENCE TO THE RELATED APPLICATION

The present application is closely related to a U.S. Patent Application filed on the even date (Priority application No. JP2006-181881 filed Jun. 30, 2006).

BACKGROUND OF THE INVENTION

The present invention relates to a coil component, and more particularly to a type thereof including terminal electrodes and a conducting wire, in which each end of the conducting wire is electrically connected to respective terminal electrode.

A coil component such as a common mode filter has been known in which a plurality of insulated conducting wires are wound over a drum type core. Japanese Patent Application Publication No. 2004-14671 discloses the drum type core including a core part and a pair of flange parts each coupled to each axial end of the core part. The plurality of conducting wires, for example, two wires, are each wound over the core part of the drum type core.

A plurality of terminal electrodes, whose number corresponds to the numbers of conducting wires, are provided at each flange part. One end portion of each conducting wire is electrically connected to each terminal electrode of each flange part. The other end of each conducting wire is electrically connected to each terminal electrode of the other flange part. For the connection, the insulation coating at each end portion of each conducting wire has been peeled off.

Each terminal electrode is constituted by a metallic terminal bracket. A portion of the terminal electrode to which each end of each conducting wires is connected will be referred to as a connection part.

Each terminal electrode has a temporary wire holding part at a position close to the connection part for holding the end portion of the conducting wire to facilitate electrical connection by for example welding. The insulated layer is made from urethane, for example. However, in the conventional coil component, more improved electrical connection is required at the connection part.

SUMMARY

Accordingly, it is an object of the present invention to provide a coil component having an improved connection part ensuring satisfactory electrical connection between the terminal electrode and the end portion of the conducting wire.

This and other objects of the present invention will be attained by a coil component including at least one conducting wire, a core, and terminal electrodes. The at least one conducting wire is provided with an insulation coating having a distal edge. The at least one conducting wire is wound over the core. The core has mounting portions to be mounted on a circuit board. The terminal electrodes are provided at the mounting portions and have numbers corresponds to the numbers of end portions of the at least one conducting wire. Each terminal electrode has a welded portion at which each of the end portions of the at least one conducting wire is electrically connected to each of the terminal electrodes upon welding.

Each welded portion has a bulge portion bulging in a direction away from the core and in contact with only the distal edge of the insulation coating.

DETAILED DESCRIPTION

A coil component according to an embodiment of the present invention will be described with reference to FIG. 1 through FIG. 5. The embodiment pertains to a common mode filter.

Figure 1:
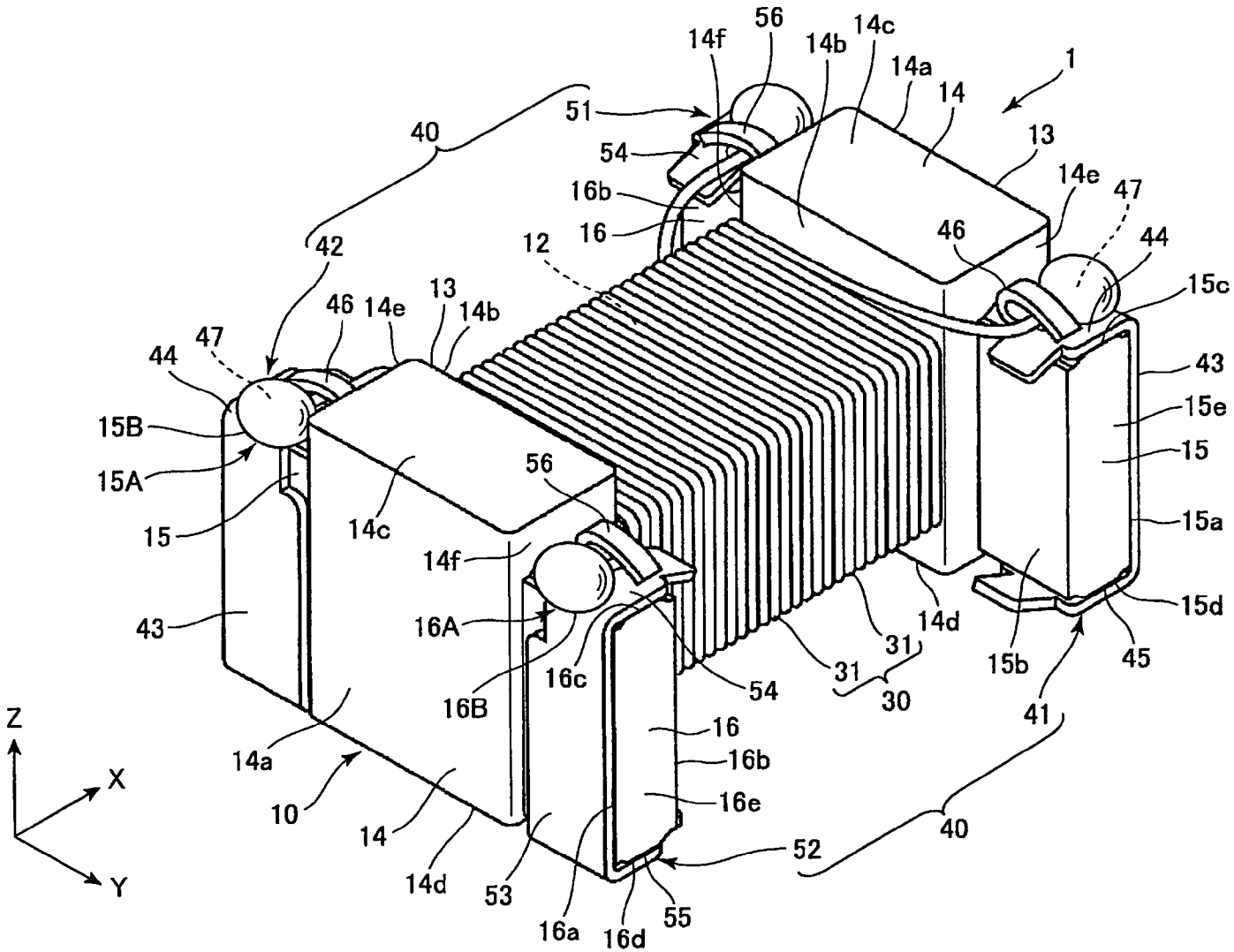
FIG. 1 is a perspective view showing a coil component according to an embodiment of the present invention.

In FIG. 1, a common mode filter 1 includes a core 10, a winding 30 and a terminal electrode 40. The core 10 is a so-called drum type core, and includes a core part 12, and a pair of flanges 13 formed at both ends of the core part 12 in the axial direction. The core 10 is made from a magnetic material such as a ferrite or a non-magnetic material such as a ceramics. The core part 12 is formed into a quadrangular column. Each of the flanges 13 is formed into a rectangular column, and serves as a mounting portion with respect to a circuit board (not shown).

The core part 12 and the flanges 13 are formed integrally. A combination of the core part 12 and two flanges 13 is H-shaped in cross-section taken along a plane extending on an axis of the core part 12. The two flanges 13 have shape generally identical to each other. Therefore, a description is hereinafter given for only one of the flanges unless otherwise specified. By definition, a longitudinal direction of the core part 12 will be referred to as "X-axis direction", a widthwise direction of the core part 12 will be referred to as "Y-axis direction", and the direction orthogonal to the X-axis and Y-axis directions will be referred to as "Z-axis direction", as shown in FIG. 1.

The flange 13 includes a first part 14 coupled to the core part 12, a second part 15 protruding from the first part 14 in the Y-axis direction and extending in X-axis direction; and a third part 16 protruding from the first part 14 in the direction opposite to the second part 15 and extending in Z-axis direction. The second part 15 and the third part 16 are symmetric with each other with respect to a Z-X plane extending through an axis of the core part 12.

In the first part 14, Z-axis direction is a longitudinal direction, and Y-axis direction is a widthwise direction. The first part 14 is a generally rectangular column having a width almost equal to that of the core part 12. The first part 14 includes a pair of first sides 14*a* and 14*b*, a pair of second sides 14*c* and 14*d*, and a pair of third sides 14*e* and 14*f*. The first sides 14*a* and 14*b* face each other as viewed in the X-axis direction. The second sides 14*c* and 14*d* face each other as viewed in the Z-axis direction, extending in the direction to cross the first sides 14*a* and 14*b* (the orthogonal direction in the embodiment). The third sides 14*e* and 14*f* face each other as viewed in the Y-axis direction, extending in the direction where the third sides 14*e* and 14*f* cross the first sides 14*a* and 14*b* and the second sides 14*c* and 14*d* (the orthogonal direction in the embodiment), respectively. The first sides 14*a* and 14*b* are each orthogonal to the axial direction of the core part 12. The core part 12 is coupled to the first side 14*b*.

The second part 15 protrudes from the third side 14*e* of the first part 14 in the Y-axis direction. The second part 15 has a generally rectangular column shape having its longitudinal direction in the Z-axis direction. The second part 15 includes a pair of first sides 15*a* and 15*b*, a pair of second sides 15*c* and 15*d*, and a third side 15*e*. The first sides 15*a* and 15*b* face each other as viewed in the X-axis direction. The second sides 15*c* and 15*d* face each other as viewed in the Z-axis direction, extending in the direction to cross the first sides 15*a* and 15*b*. The third side 15*e* extends in the direction to cross the first side 15*a* and 15*b*, and the second sides 15*c* and 15*d*. The first sides 15*a* and 15*b* are each orthogonal to the axial direction of the core part 12. A step is formed between the second side 14*c* of the first part 14 and the second side 15*c* of the second part 15 across the third side 14*e* so that the second side 15*c* of the second part 15 is positioned lower than the second side 14*c* of the first part 14.

The third part 16 protrudes from the third side 14*f* of the first part 14 in the Y-axis direction. The third part 16 is a generally rectangular column having its longitudinal direction in the Z-axis direction. The third part 16 includes a pair of first sides 16*a* and 16*b*, a pair of second sides 16*c* and 16*d*, and a third side 16*e*. The first sides 16*a* and 16*b* face each other as viewed in the X-axis direction. The second sides 16*c* and 16*d* face each other as viewed in the Z-axis direction, extending in the direction to cross the first sides 16*a* and 16*b*. The third side 16*e* extends in the direction to cross the first sides 16*a* and 16*b*, and the second sides 16*c* and 16*d*. The first sides 16*a* and 16*b* are each orthogonal to the axial direction of the core part 12. A step is formed between the second side 14*c* of the first part 14 and the second side 16*c* of the third part 16 across the third side 14*f* so that the second side 16*c* of the third part 16 is positioned lower than the second side 14*c* of the first part 14.

The winding 30 includes two conducting wires 31. Each of the conducting wires 31 is insulated with a material having a heat resistance capable of avoiding melting when the conducting wire 31 is welded to a terminal bracket 40 by pulsed laser. The winding 30 is wound around the core part 12 so as to form a coil-wound portion. The two conducting wires 31 are magnetically coupled to each other but electrically insulated from each other. For each of the conducting wires 31, insulated wires such as polyurethane coated copper wire and polyamide-imide coated copper wire are available.

The terminal electrode 40 includes terminal brackets such as first terminal electrodes 41 and 42, and second terminal electrodes 51 and 52. The first terminal electrodes 41 and 42 are each fitted to the second part 15 of the flange 13. The second terminal electrodes 51 and 52 are each fitted to the third part 16 of the flange 13. The first terminal electrode 42 and the second terminal electrode 52 are electrically connected to one ends of the two conducting wires 31, respectively. The first terminal electrode 41 and the second terminal electrode 51 are electrically connected to the other ends of the two conducting wires 31, respectively.

Each of the first terminal electrodes 41 and 42 includes a first terminal 43, a pair of second terminals 44 and 45 extending from each end of the first terminal 43, and first/second pieces 46 and 47 extending from the second terminal 44. The first terminal 43, the pair of second terminals 44 and 45, and the first piece 46 and a second piece 47 are formed by bending a metal plate. The first terminal 43 faces the first side 15*a* of the second part 15 of the flange 13. The second terminal 44 faces the second side 15*c* of the second part 15 of the flange 13. The second terminal 45 faces the second side 15*d* of the second part 15 of the flange 13. Each end of the pair of second terminals 44 and 45 is bent toward the core part 12.

The first and second pieces 46 and 47 hold the end portion of the conducting wire 31 with the second terminal 44 for connection. The first and second pieces 46 and 47 extend from one end of the second terminal 44 in the Y-axis direction. The first piece 46, as will be described later, serves as a temporary fixing element for securing the conducting wire 31 temporarily while the conducting wire 31 is being laser-welded to the second piece 47. The first piece 46 is bent to hold the end portion of the conducting wire 31, with the second terminal 44.

The second piece 47 serves as a fixing element converted into a molten state upon laser welding. The second piece 47 is bent so as to hold the end portion of the conducting wire 31 with the second terminal 44 (The second piece 47 referred herein is identical to a second piece 57 in FIGS. 2 and 3). In a state that the first piece 46 and the second piece 47 hold the end portion of the conducting wire 31 with the second terminal 44, laser welding is performed as will be described later. The first terminal electrode 41 is thus connected to the end portion of the conducting wire 31 mechanically and electrically. Prior to fitting the first terminal electrodes 41 and 42 to the flange 13, the first terminal 43 in the Z-axis direction is slightly longer than the first side 15*a* in the Z-axis direction, and the distance between free ends of the pair of second terminals 44 and 45 in the Z-axis direction is slightly shorter than the first side 15*a* in the Z-axis direction.

The first terminal electrodes 41 and 42 are fixed to the second part 15 of the flange 13 by the pair of second terminals 44 and 45 holding the pair of second sides 15*c* and 15*d*. In order to fit each of the first terminal electrodes 41 and 42 to the second part 15 of the flange 13, the first terminal electrodes 41 and 42 cover the second part 15 from the side of the first side 15*a* of the second part 15, while a distance between the pair of second terminals 44 and 45 is increasing.

Each of the second terminal electrodes 51 and 52 includes a first terminal 53, a pair of second terminals 54 and 55 extending from each end of the first terminal 53, and first and second pieces 56 and 57 extending from the second terminal 54. The first terminal 53, the pair of second terminals 54 and 55, and the first and second pieces 56 and 57 are formed by bending a metal plate (see FIGS. 2 and 3). The first terminal 53 faces the first side 16*a* of the third part 16 of the flange 13. The second terminal 54 faces the second side 16*c* of the third part 16 of the flange 13. The second terminal 55 faces the second side 16*d* of the third part 16 of the flange 13. Each end of the pair of second terminals 54 and 55 is bent toward the core part 12.

The first and second pieces 56 and 57 are adapted for holding the end portion of the other conducting wire 31 with the second terminal 54 for connection. The first and second pieces 56 and 57 extend from an end of the second terminal 54 in the Y-axis direction. The first piece 56, as will be described later, is a temporary fixing element for securing the conducting wire 31 temporarily while the conducting wire 31 is being laser-welded to the second piece 57. The first piece 56 is bent to hold the end portion of the conducting wire 31, with the second terminal 54.

The second piece 57 serves as a fixing element converted into a molten state upon laser welding. The second piece 57 is bent from the state shown in FIG. 2 so as to hold the conducting wire 31 with the second terminal 54 as shown in FIG. 3. In a state that the first and second pieces 56 and 57 hold the end portion of the conducting wire 31 with the second terminal 54, laser welding is performed. The second terminal electrode 51 is thus connected to the end portion of the conducting wire 31 mechanically and electrically. Prior to fitting the second terminal electrodes 51 and 52 to the flange 13, the first terminal 53 in the Z-axis direction is slightly longer than the first side 16*a* in the Z-axis direction, and the distance between free ends of the pair of second terminals 54 and 55 in the Z-axis direction is slightly shorter than the first side 16*a* in the Z-axis direction.

The second terminal electrodes 51 and 52 are fixed to the third part 16 of the flange 13 by the pair of second terminals 54 and 55 holding the pair of second sides 16*c* and 16*d*. In order to fit each of the second terminal electrodes 51 and 52 to the third part 16 of the flange 13, the second terminal electrodes 51 and 52 cover the third part 16 from the side of the first side 16*a* of the third part 16, while a distance between the pair of second terminals 54 and 55 is increasing.

Figure 2:
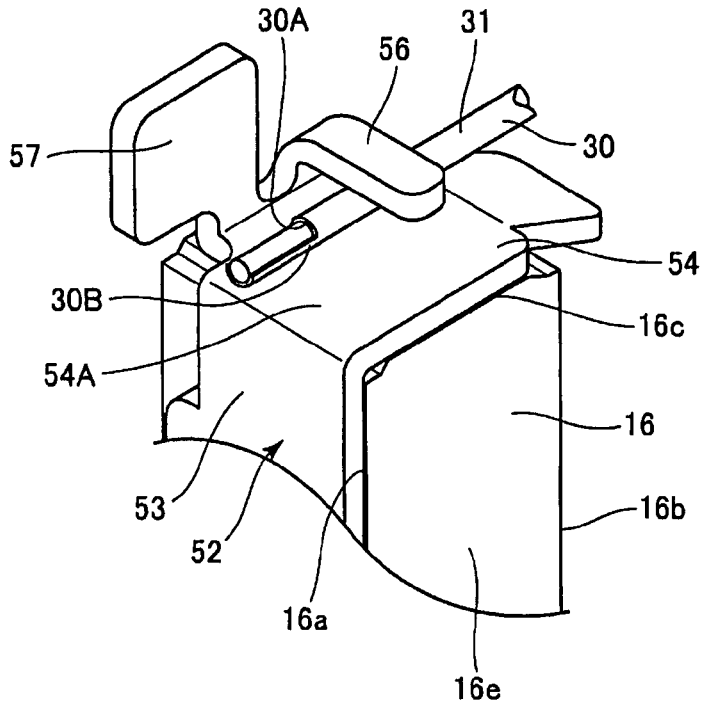
FIG. 2 is an enlarged perspective view of an essential portion of the coil component according to the embodiment, and showing a state prior to a connection of a conducting wire to a terminal electrode.
Figure 3:
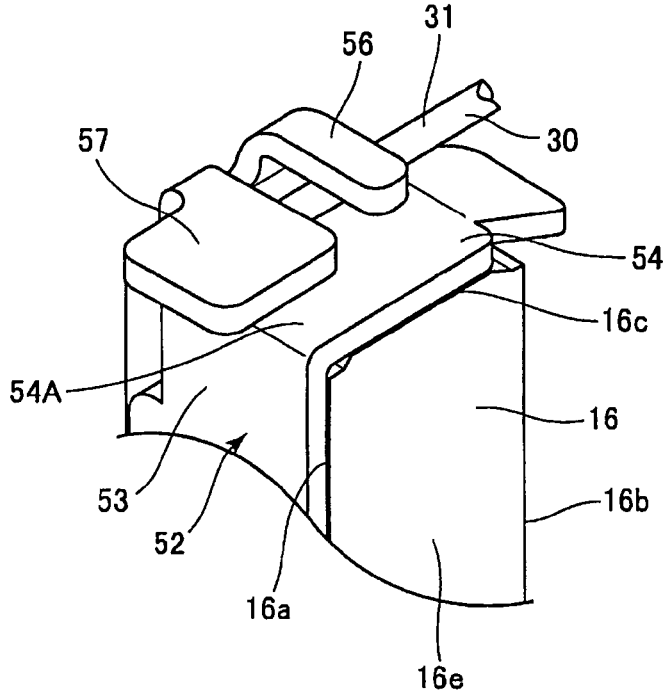
FIG. 3 is an enlarged perspective view of the essential part of the coil component according to the embodiment and showing an another state prior to the connection of the conducting wire to the terminal electrode.
Figure 4:
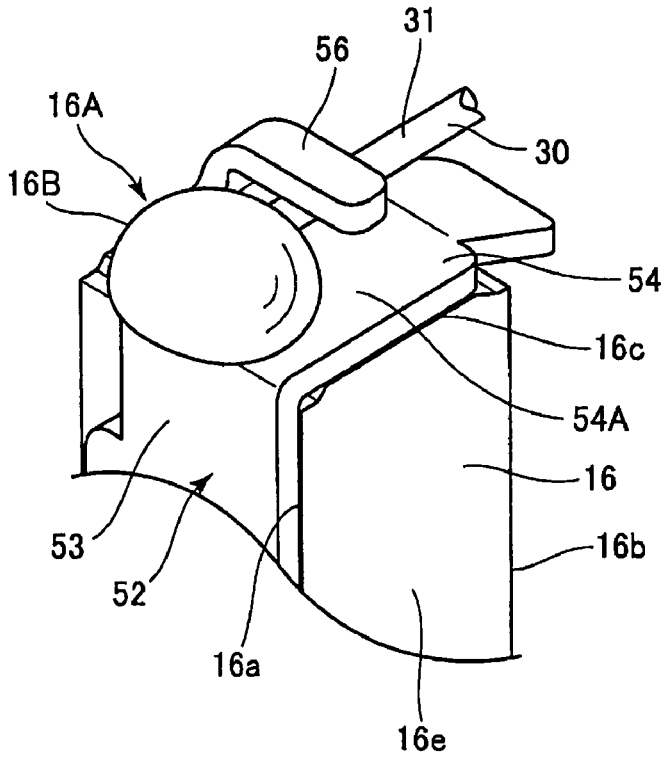
FIG. 4 is an enlarged perspective view of the essential portion of the coil component according to the embodiment and showing a state after connection of the conducting wire to the terminal electrode.

Referring to FIG. 2, the end portion of the conducting wire 31 to be held by the second piece 57 and the second terminal 54 has a substantially upper diametrically half portion where its covering has been stripped off. The stripping is performed by irradiating the substantially upper half of the insulation covering at the end portion of the conducting wire 31 with a pulsed laser beam.

On the other hand, referring again to FIG. 2, the end portion of the conducting wire 31 has a substantially lower diametrically half portion where its covering has not been stripped off (lower covering portion 30B remains), without being irradiated with a pulsed laser beam. The lower half insulation covering portion located beyond the first piece 56 at a predetermined position 30A toward a distal end of the conducting wire 31 remains un-stripped. This means that the conducting wire 31 has the lower covering portion 30B extending from the predetermined position 30A to the distal end. The lower covering portion 30B serves as an insulating layer. The predetermined position 30A corresponds to an insulation covering edge which defines a border between a bulged portion 16A (to be described later) and the insulation 30.

As mentioned above, the second piece 57 is melted by laser welding. Further, the end portion of the conducting wire 31 held by the second piece 57 and the second terminal 54 is also melted. Furthermore, a surface area of the second terminal 54, the surface area being facing the second piece 57 and the end portion of the conducting wire 31, is also melted by laser welding. On the other hand, a portion directly facing the second side 16*c* of the third part 16 of the flange 13, i.e., a lower portion of second terminal 54 in its thickness direction shown in FIG. 5 remains non-melted as a foundation 54A.

Figure 5:
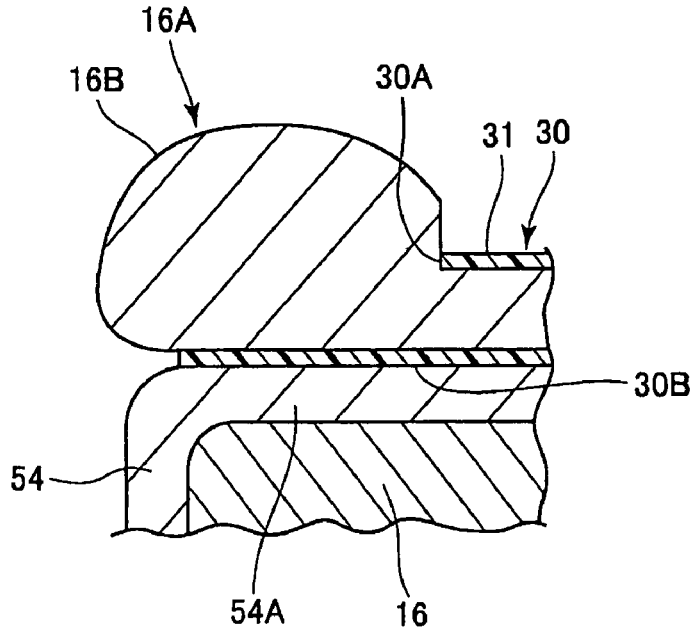
FIG. 5 is an enlarged cross-sectional view of the essential portion particularly showing a bulged or rounded portion in the coil component according to the embodiment.

The above parts are thus melted to be mixed with one another, thereby forming a melted portion 16A. As shown in FIG. 5, the melted portion 16A includes a bulge 16B which bulges in a direction away from the second side 16*c* of third part 16. In this case, the "bulge 16B" corresponds to a substantially upper portion of the so-called welding ball, except its lower end, which bulges generally hemispherically in a direction away from the third part 16. The bulge 16B does not include the portion which faces the foundation 54A and the insulation covering.

As the end portion of the conducting wire 31 is welded by laser welding to the foundation 54A which is the lower part of the second terminal 54, the melted bulge 16B comes into contact with the covering edge 30A, thereby determining the shape, the position and the size of the bulge 16B. In a state that the bulge 16B has been solidified upon cooling, the bulge 16B is in contact only with the covering edge 30A as shown in FIG. 5. The conducting wire 31 is covered for insulation from the first piece 56 to the bulge 16B.

Since the bulge 16B is in contact only with the covering edge 30A, the shape of the bulge 16B constituting the welded part 16A is determined. This allows the connection state to be stabilized, thereby maintaining stable quality of the common mode filter 1. Furthermore, the shape of the bulge 16B in the welded part 16A becomes manageable by the covering edge 30A.

A plate core (not shown) can be placed above the common mode filter 1 so as to make a closed magnetic circuit. To this effect, the plate core will be fixed to the second sides 14*c* and 14*c* of the pair of flanges 13. In this case, if the size of the bulge 16B is too large, the bulge 16B will prevent the plate core from directly contacting with the second sides 14*c*, 14*c* of the pair of flanges 13. On the other hand, in the illustrated embodiment, since the shape of the bulge 16B is managed stably as described above, excessive increase in size of the bulge 16B can be avoided. Therefore, the bulge 16B does not become an obstacle for this fixing. Therefore any assembly error of the plate core to the flanges 13 can be obviated.

Further, the conducting wire 31 is covered for insulation from the first piece 56 to the bulge 16B, thereby preventing the bulge 16B in the welded part 16A from moving to the first piece 56, which causes the first piece 56 to be also welded together. That is, the covering edge 30A can dam up the molten materials. This makes full use of the capabilities of the first piece 56 in the following cases:

That is, the first piece 56 can perform positioning of an end portion of the conducting wire 31 from its leading end to the coil-wound start portion. The first piece 56 can perform heat releasing during welding. The first piece 56 can disperse tension applied to the conducting wire and avoid displacement of the conducting wire in a direction from the welded part 16A to the coil-would portion. Such inherent advantage of the first piece 56 can still be performed even during and after the formation of the bulge 16B.

As has been described above, the end portion of the conducting wire 31 has the lower covering portion 30B where the covering remains unstripped for the substantially lower half of the conducting wire 31 between the foundation 54A and a portion corresponding to the end portion of the conducting wire 31. In this case, as has been described above, since the conducting wire 31, the second piece 57, and the second terminal 54 are melted to be mixed with one another, the bulge 16B has no clear positional indication for the end portion of the conducting wire 31. Therefore, the position where the end portion of the conducting wire 31 held by the second piece 57 and the second terminal 54 before laser welding is performed, is defined as an equivalent portion corresponding to the end portion of the conducting wire 31.

As has been described above, for the substantially upper half of the end portion of the conducting wire 31, its covering has been stripped off with a pulsed laser beam prior to welding. Therefore, the covering does not remain in the upper portion of the bulge 16B. The insulation covering is provided only between the foundation 54A and the equivalent portion corresponding to the end portion of the conducting wire 31, as the lower covering portion 30B.

An insulation covering is thus provided only between the foundation 54A and the equivalent portion corresponding to the end portion of the conducting wire 31 in the bulge 16B, whereby the lower covering portion 30B prevents the equivalent portion from being excessively welded to the terminal electrode 40. Then, excessive melting and deformation of the terminal electrode 40 can be avoided. This allows the common mode filter 1 to have a satisfactory welded part 16A as the connection part.

Since the conducting wire 31 is insulated with a covering, the covering is available as the lower covering portion 54A. This reduces the number of parts, thereby reducing the number of steps of manufacturing the common mode filter 1. As a result, the cost for manufacturing the common mode filter 1 can be reduced.

Although the above description has been given only for the welded part 16A of the second terminal 54, a welded part 15A has a structure similar to the welded part 16A, and the second terminal 44 has also a structure similar to the second terminal 54.

Next, a process for manufacturing the common mode filter 1 according to the embodiment will be described. First, the core 10 and the terminal electrode 40 (first terminal electrodes 41, 42 and second terminal electrodes 51, 52) are prepared. Each of the terminal electrodes 41, 42, 51, and 52 is fitted to the core 10. After that, each end of the second terminals 44, 45, 54 and 55 is bent toward the core part 12.

Next, one conducting wire 31 is prepared so as to be wound around the core part 12. One end and the other end of the conducting wire 31 are held by the first pieces 46, 56 and the second terminals 44, 54, respectively. The conducting wire 31 is temporarily fixed to each of the terminal electrodes 41 and 52. The conducting wire 31 is then cut off.

Next, the other conducting wire 31 is prepared so as to be wound around the core part 12. One end and the other end of the conducting wire 31 are held by the first pieces 46, 56 and the second terminals 44, 54, respectively. The conducting wire 31 is temporarily fixed to each of the terminal electrodes 51 and 42. The conducting wire 31 is then cut off. The winding 30 is thus formed.

Next, the covering of the winding 30 (each of the conducting wires 31) is partially stripped off. The stripping is performed by irradiating the covering for the portion directly facing the second pieces 47 and 57 at the end portion of the winding 30 temporarily fixed to each of the terminal electrodes 41, 42, 51 and 52. The covering to be irradiated is on the side opposite to the side directly facing the terminal electrodes 41, 42, 51, and 52. Irradiation is performed with a pulsed laser beam using a YAG laser irradiation device (not shown). More specifically, from the position above the area shown in FIG. 2, only one pulsed laser beam is applied for a duration of not more than 40 nsec. so that the covering is stripped off. The pulsed laser beam has a wavelength of 1064 nm, a pulse width of not more than 100 nsec, a frequency of 20 Hz, and an irradiation energy of 230 $J/m^2 \pm 10\%$, approximately.

Next, referring to FIG. 1, the second pieces 47 and 57 are bent so as to hold the end portion of the winding 30, where the covering has been stripped off, with the second terminals 44 and 54. With this structure, both end portions of the winding 30 are temporarily fixed to each of the terminal electrodes 41, 42, 51, and 52.

Next, a pulsed laser beam is applied to the end portion of the winding 30, where the covering has been stripped off, the terminal electrodes 41, 42, 51, and 52, and the second pieces 47 and 57, for predetermined period of time using a laser irradiation device (not shown). Welding is then performed so that each end portion of the winding 30 is connected to each of the terminal electrodes 41, 42, 51, and 52, respectively. The area to be irradiated with a laser beam preferably includes the second pieces 47 and 57, and the end portion. For the laser beam, similarly to the case when the covering is stripped off, a YAG laser irradiation device is available for applying a pulsed laser beam.

As welding is started, the portion of the winding 30, where the covering has been stripped off, the terminal electrodes 41, 42, 51, and 52, and the second pieces 47 and 57 are melted to be mixed with one another. Thus, the melting bulge 16B is formed. Although the bulge 16B is ready to move toward the core part 12 along the winding 30, the covering edge 30A comes into contact with the bulge 16B so as to prevent the bulge 16B from moving. Thus, the bulge 16B is subjected to positioning. Accordingly, the size and the shape of the bulge 16B are determined.

In this case, the lower covering portion 30B is provided between the bulge 16B and the foundation 54A including the terminal electrodes 41, 42, 51, and 52, thereby preventing the terminal electrodes 41, 42, 51, and 52 from being excessively welded. Through these steps, the common mode filter 1 having the above structure is obtained.

While the invention has been described in detail and with reference to the specific embodiment thereof, it is apparent to those skilled in the art that various changes and modifications may be made therein without departing from the spirit of the invention.

For example, in the embodiment described above, a pulsed laser beam using a YAG laser irradiation device is applied so as to weld the peeled off end portion of the wire where its covering has been stripped off to each of the terminal electrodes 41, 42, 51, and 52. However, other welding method including arc welding is also available. Further, instead of welding, soldering or brazing can be applied using a solder or brazing filler metal.

For example, when soldering is performed, melting of the end portion of the winding 30 as well as each of the terminal electrodes 41, 42, 51, and 52 do not occur. In this case, the end portion of the winding 30 is electrically connected to each of the terminal electrodes 41, 42, 51, and 52 through solder. For the bulge 16B, the lower covering portion 30B is provided between the end portion of the winding 30 and the foundation 54A. Further, the shape of the bulge 16B is regulated by the covering edge 30A. That is, the bulge 16B is in contact only with the covering edge 30A.

In the embodiment, the covering of the conducting wire 31 is utilized so that the lower covering portion 30B is provided between the end portion of the winding 30 and the foundation 54A in the bulge 16B. However, instead of the lower covering portion 30B of the conducting wire 31, an independent insulating layer can be provided, which has been separately positioned at the corresponding portion.

What is claimed is:

1. A coil component comprising:

at least one conducting wire provided with an insulation coating having a distal edge;

a core on which the at least one conducting wire is wound, the core having mounting portions to be mounted on a circuit board; and terminal electrodes provided at the mounting portions and having numbers corresponds to the numbers of end portions of the at least one conducting wire, each terminal electrode having a welded portion at which each of the end portions of the at least one conducting wire is electrically connected to each of the terminal electrodes upon welding, each welded portion having a bulge portion bulging in a direction away from the core and in contact with only the distal edge of the insulation coating.

2. The coil component as defined in claim 1, wherein the insulation covering is made from a material providing a heat resistance capable of avoiding melting at a temperature required for electrically connecting the end portion to the terminal electrode by a laser welding.

3. The coil component as defined in claim 1, wherein each terminal electrode comprises a terminal bracket each including a holding portion that temporarily holds each end portion at a position close to the welding portion, each end portion having a region from the holding portion to the bulge portion, the region being entirely covered with the insulation coating.

4. The coil component as defined in claim 1, wherein each of the terminal electrodes has a foundation portion facing each end portion, the bulge portion facing the foundation, and the coil component further comprising an insulating layer provided in the bulge portion at a position between an equivalent end portion corresponding to the end portion and the foundation portion.

5. The coil component as defined in claim 4, wherein the insulating layer is a part of the insulation coating.

6. The coil component as defined in claim 4, wherein each of the terminal electrode is in a form of a terminal bracket, a part of the terminal bracket and the end portion of the conducting wire forming the equivalent end portion in the bulge portion as a result of melting thereof upon laser welding.

* * * * *